US012377312B2

(12) United States Patent
Ifekwe

(10) Patent No.: US 12,377,312 B2
(45) Date of Patent: Aug. 5, 2025

(54) LOCK DEVICE FOR A STATIONARY BICYCLE

(71) Applicant: Daniel Ifekwe, North York (CA)

(72) Inventor: Daniel Ifekwe, North York (CA)

( * ) Notice: Subject to any disclaimer, the term of this patent is extended or adjusted under 35 U.S.C. 154(b) by 126 days.

(21) Appl. No.: 18/479,352

(22) Filed: Oct. 2, 2023

(65) Prior Publication Data

US 2025/0108252 A1 Apr. 3, 2025

(51) Int. Cl.
*A63B 22/06* (2006.01)

(52) U.S. Cl.
CPC ..... *A63B 22/0605* (2013.01)

(58) Field of Classification Search
CPC .... A63B 22/0605; B65D 50/00; B65D 50/02; B65D 50/04; B65D 50/041; B65D 50/043; B65D 50/045; B65D 50/046; B65D 50/048; E05B 65/0014
See application file for complete search history.

(56) References Cited

U.S. PATENT DOCUMENTS

| | | | | |
|---|---|---|---|---|
| 5,201,202 | A | 4/1993 | Kam | |
| 5,425,256 | A | 6/1995 | Crosby | |
| 6,324,879 | B1 | 12/2001 | Kennedy | |
| 7,802,828 | B2 | 9/2010 | Dykstra et al. | |
| 9,492,700 | B1 * | 11/2016 | Wu | A63B 21/015 |
| 9,839,810 | B1 * | 12/2017 | Tzeng | A63B 21/015 |
| D940,534 | S | 1/2022 | Xie | |
| 11,504,564 | B2 * | 11/2022 | Hsu | A63B 21/015 |
| 11,524,198 | B2 * | 12/2022 | Hsu | A63B 21/00072 |
| 11,794,054 | B2 * | 10/2023 | Petrillo | A63B 21/225 |
| 12,239,870 | B2 * | 3/2025 | Petrillo | A63B 21/015 |
| 2017/0036053 | A1 * | 2/2017 | Smith | A63B 21/015 |
| 2022/0008790 | A1 * | 1/2022 | Chen | H02K 49/108 |
| 2023/0093086 | A1 * | 3/2023 | Petrillo | A63B 21/015 482/5 |
| 2023/0181957 | A1 * | 6/2023 | Chen | A63B 22/0605 482/63 |

OTHER PUBLICATIONS

"CozyCuddles stove knob covers protector kit—Easy to use covers for standard gas and electric stoves and ovens—child safety guards for baby and toddler—5 pieces, white" Amazon; https://www.amazon.com/PREMIUM-Stove-Covers-Toddler-Safety/dp/B07BLGZTGN/ref=psdc_165797011_t3_B09QC9RK3C; Retrieved Jan. 12, 2024.

"Stove knob covers for child safety" Amazon https://www.amazon.com/Covers-Safety-Universal-Double-Key-Double-Sided/dp/B09QC9RK3C; Retrieved Jan. 12, 2024.

* cited by examiner

*Primary Examiner* — Joshua Lee
(74) *Attorney, Agent, or Firm* — Gibraltar Consulting LLC; Tariq S. Najee-ullah

(57) ABSTRACT

A locking device for a stationary bicycle may include a housing having a knob receiving wall and a sidewall. The sidewall has a first end connected to the knob receiving wall and a second end forming an opening. The knob receiving wall is located opposite the opening of the housing. A chamber is configured to receive a knob of the stationary bicycle. A first latch is connected to the outer wall surface of the sidewall of the housing. A lock device may include a base having an aperture configured to receive at least a portion of the rod. The first latch of the housing is removably connected to a capturing structure of the base. The knob receiving wall of the housing is configured to connect to the knob and depress the knob to engage an emergency brake of the stationary bicycle when the housing is connected to the base.

11 Claims, 14 Drawing Sheets

LOCK DEVICE FOR A STATIONARY BICYCLE

FIELD OF INVENTION

Embodiments disclosed herein relate to a locking device for a stationary bicycle that is configured for engagement of an emergency brake mechanism.

BACKGROUND OF THE INVENTION

A stationary bicycle has an emergency brake system that, when engaged, prevents the pedals from moving and prevents the flywheel from moving. A knob is connected to an end of a rod. The rod is connected to the bicycle. When the knob is depressed, the emergency brake is engaged. When the rod is turned, the resistance is variable. A problem arises when any individual such as a child is playing on the stationary bicycle and may become entangled in the gear device if the pedals are inadvertently rotated and a child is near the gear device. This may result in injury and/or death. Thus, it would be more desirable for a child safety lock device to be connected to a stationary bicycle to prevent the pedals from rotating when the stationary bicycle is not in use during storage and/or between sessions.

Previous approaches for locking devices for stationary bicycles have typically involved complex mechanisms and multiple components, resulting in increased manufacturing costs and potential points of failure. These locking devices often require manual adjustment and may not provide a secure and reliable connection between the housing and the base. However, none of these approaches have provided a comprehensive solution that combines the features described in this disclosure. The present invention aims to address these limitations and provide an improved locking device for stationary bicycles that is secure, easy to use, and incorporates an effective engagement of an emergency brake mechanism.

Accordingly, there remains a need for an improved lock device for a stationary bicycle. This need and other needs are satisfied by the various aspects of the present disclosure.

SUMMARY OF THE INVENTION

In accordance with the principles of the present invention, a locking device for a stationary bicycle includes a housing with a knob receiving wall and a sidewall connected to the knob receiving wall. The sidewall has an opening opposite the knob receiving wall, and a chamber is configured to receive a knob connected to a rod. A first latch is connected to the outer wall surface of the sidewall. The device also includes a base with an aperture to receive a portion of the rod and a capturing structure. The first latch of the housing is removably connected to the capturing structure of the base. When the housing is connected to the base, the knob receiving wall depresses the knob to engage an emergency brake, and which also includes improvements that overcome the limitations of prior art locking device systems for stationary bicycles is now met by a new, useful, and non-obvious invention.

In some aspects, the techniques described herein relate to a locking device for a stationary bicycle, including a housing having a knob receiving wall. A sidewall has an outer wall surface. The sidewall has a first end connected to the knob receiving wall. The sidewall has a second end forming an opening. The knob receiving wall is located opposite the opening of the housing. A chamber is configured to receive a knob connected to a rod. The opening of the sidewall borders the chamber. A first latch is connected to the outer wall surface of the sidewall of the housing. A base has an aperture configured to receive at least a portion of the rod. The first latch of the housing is removably connected to a capturing structure of the base. The knob receiving wall of the housing is configured to connect to the knob and depress the knob to engage an emergency brake of the stationary bicycle when the housing is connected to the base.

In some aspects, the techniques described herein relate to a locking device, wherein the first latch having a first end located opposite a second end, the first latch is tapered.

In some aspects, the techniques described herein relate to a locking device, wherein the second end of the first latch having a greater thickness than the first end of the first latch, the first end of the first latch abuts the opening of the housing.

In some aspects, the techniques described herein relate to a locking device, wherein the housing having a first channel and a second channel, the first channel is parallel to the second channel, the first channel having a first end and a second end, the first end of the first channel and the second channel abut the opening of the housing.

In some aspects, the techniques described herein relate to a locking device, wherein the first latch is located between the first channel and the second channel.

In some aspects, the techniques described herein relate to a locking device, wherein the outer wall surface of the housing having a protrusion structure, the protrusion structure is in alignment with the first latch.

In some aspects, the techniques described herein relate to a locking device, wherein the protrusion structure is a ramp, the ramp is configured to be engaged by a user to release the first latch of the housing from the capturing structure of the base, the protrusion structure is located between the first channel and the second channel.

In some aspects, the techniques described herein relate to a locking device, wherein the aperture of the base having a flange extending therefrom, the flange is removably connected to the second end of the sidewall of the housing.

In some aspects, the techniques described herein relate to a locking device, wherein the capturing structure including: a first end and a second end, the first end of the capturing structure is connected to an outer perimeter edge of the base, the second end of the capturing structure has a protruded ridge; at least one recess; a pin, the pin is configured to traverse through an opening of the protruded ridge of the second end of the capturing structure, the pin is located within the at least one recess, the pin is configured to engage the second end of the first latch when the housing is connected to the base.

In some aspects, the techniques described herein relate to a locking device, wherein a second latch connected to the outer wall surface of the sidewall of the housing, the second latch of the housing is removably connected to the capturing structure of the base.

In some aspects, the techniques described herein relate to a method of engaging an emergency brake of a stationary bicycle using a locking device, including the steps of: providing the stationary bicycle, the stationary bicycle has the emergency brake including: a brake system; a knob; a rod, the rod has one end connected to the knob located opposite another end coupled to the brake system; and a fastener, the fastener connects the rod to the stationary bicycle; loosening the fastener; providing the locking device, including: a housing, including: a knob receiving wall; a sidewall having an outer wall surface, the sidewall having a first end connected to the knob receiving wall, the sidewall having a second end forming an opening, wherein the knob receiving wall is located opposite the opening of the housing; and a chamber, the chamber is configured to receive the knob connected to the rod of the stationary bicycle, wherein the opening of the sidewall bordering the chamber; a first latch connected to the outer wall surface of the sidewall of the housing; and a base, including: an aperture, the aperture is configured to receive at least a portion of the rod; and a capturing structure, wherein the first latch of the housing is removably connected to the capturing structure of the base, wherein the knob receiving wall of the housing is configured to connect to the knob and depress the knob to engage the emergency brake when the housing is connected to the base; positioning the base of the locking device between the stationary bicycle and the fastener, wherein positioning the aperture of the base of the locking device around at least a portion of the rod; aligning the first latch of the housing with the capturing structure of the base; inserting the knob and at least a portion of the rod into the chamber of the housing of the locking device; and applying a force to the housing so that the knob receiving wall of the housing is depressing the knob and rod to engage the emergency brake of the stationary bicycle, wherein a length of the knob and the rod retained within the chamber of the housing is greater in size than a length of the chamber of the housing.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION OF THE INVENTION

The present invention can be understood more readily by reference to the following detailed description of the invention and the examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

Figure 1A:
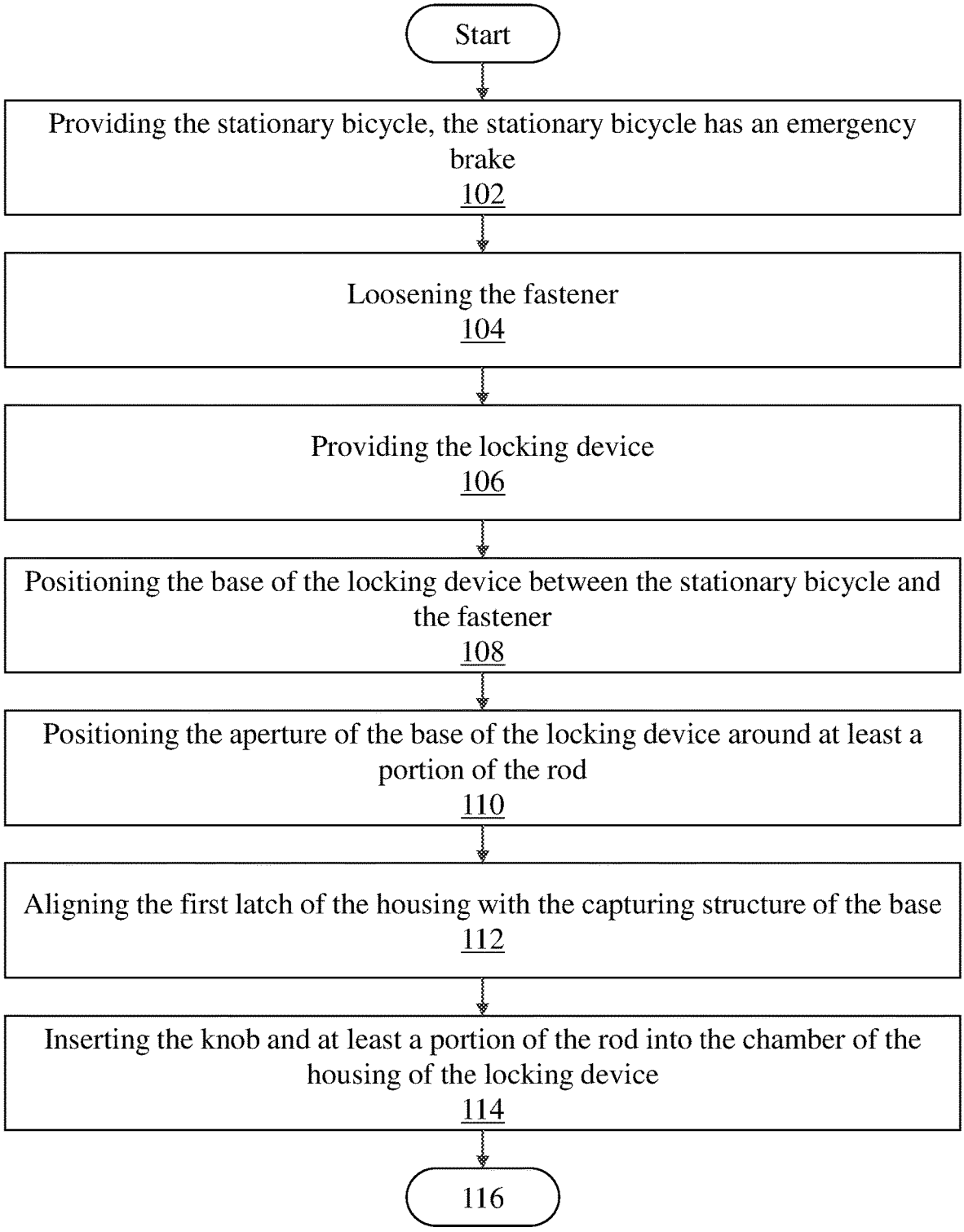
FIG. 1A is a flowchart illustrating a method of engaging an emergency brake of a stationary bicycle, according to some embodiments of the present disclosure.
Figure 1B:
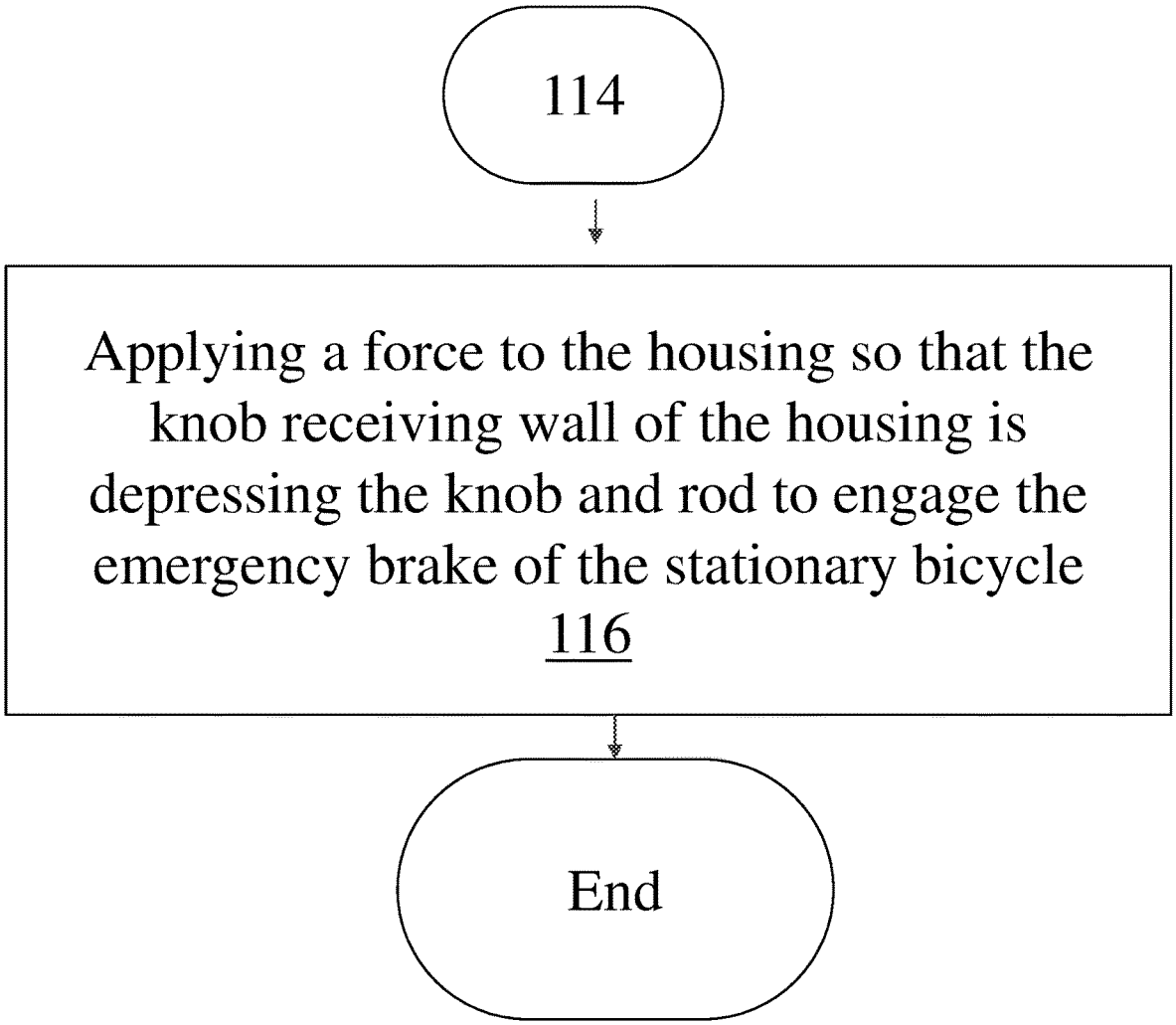
FIG. 1B is a flowchart extending from FIG. 1A and further illustrating the method of engaging an emergency brake of a stationary bicycle, according to some embodiments of the present disclosure.
Figure 8:
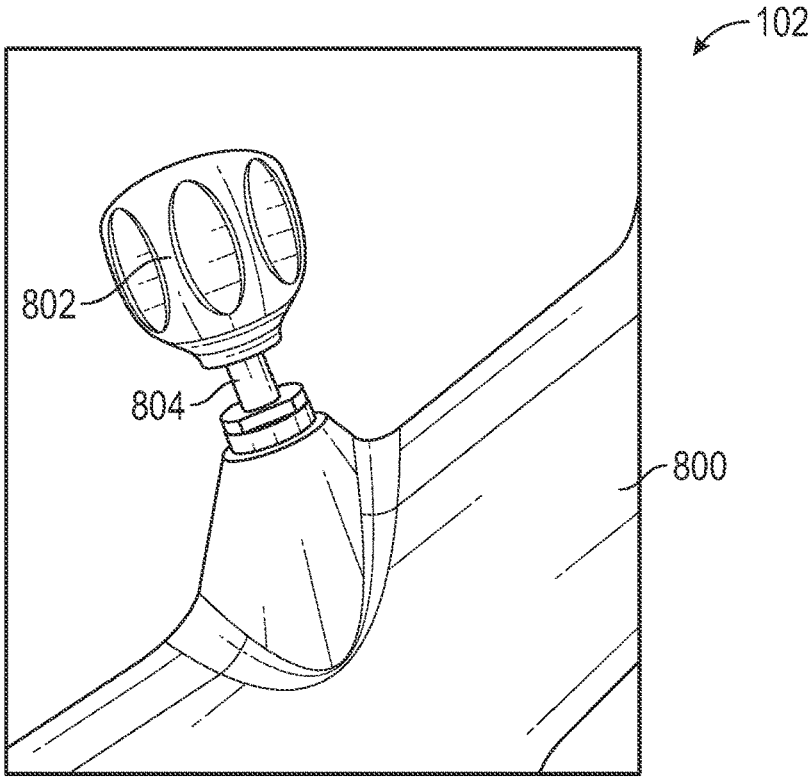
FIG. 8 is an illustration of a stationary bicycle showing an operational sequence that may be performed when engaging an emergency brake system of a stationary bicycle using a locking device, according to some embodiments of the present disclosure.
Figure 9:
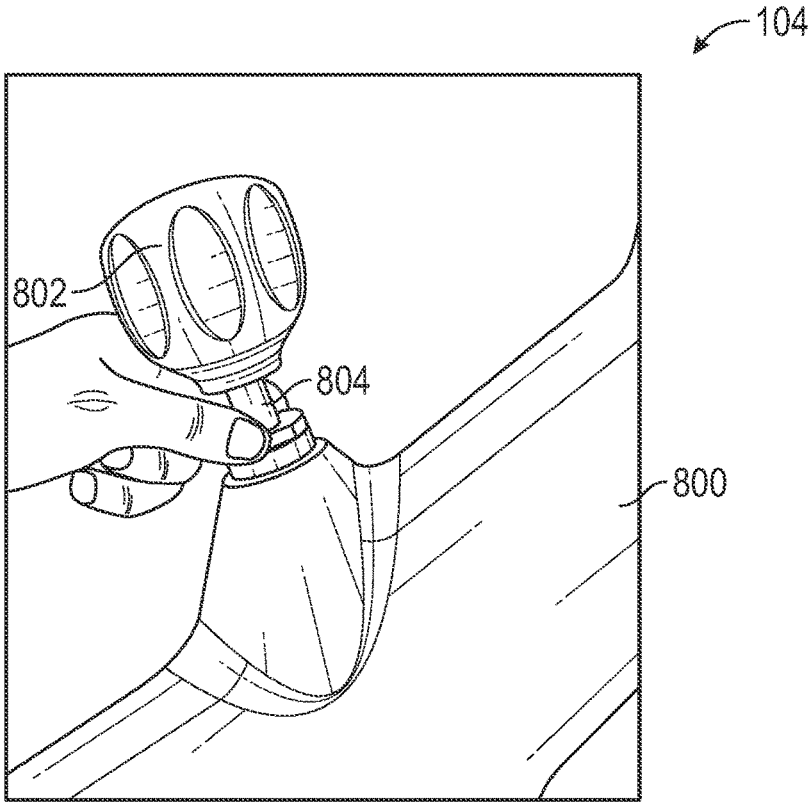
FIG. 9 is an illustration of a stationary bicycle showing an operational sequence that may be performed when engaging an emergency brake system of a stationary bicycle using a locking device, according to some embodiments of the present disclosure.
Figure 10:
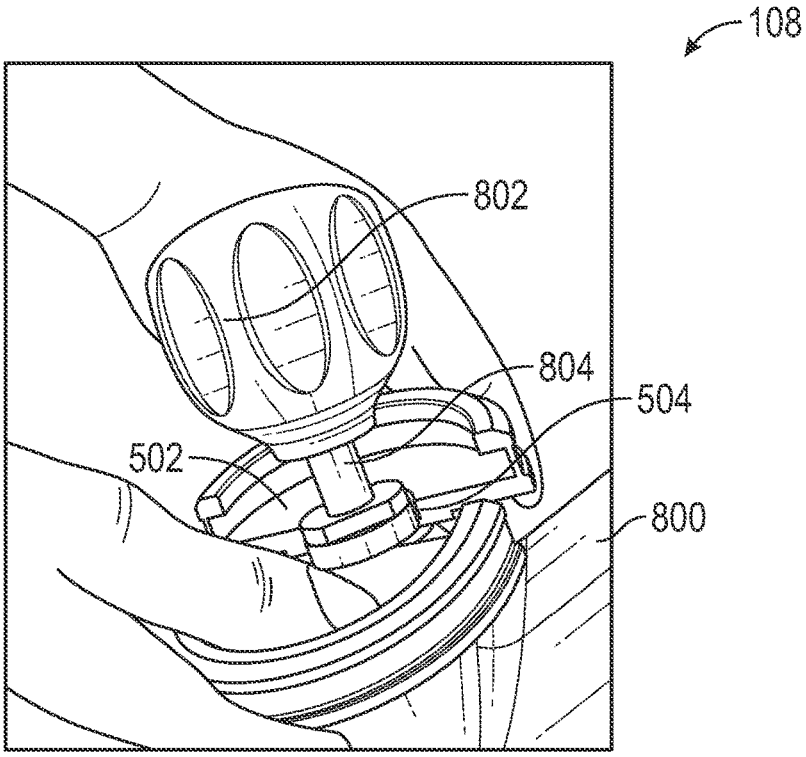
FIG. 10 is an illustration of a stationary bicycle showing an operational sequence that may be performed when engaging an emergency brake system of a stationary bicycle using a locking device, according to some embodiments of the present disclosure.
Figure 11:
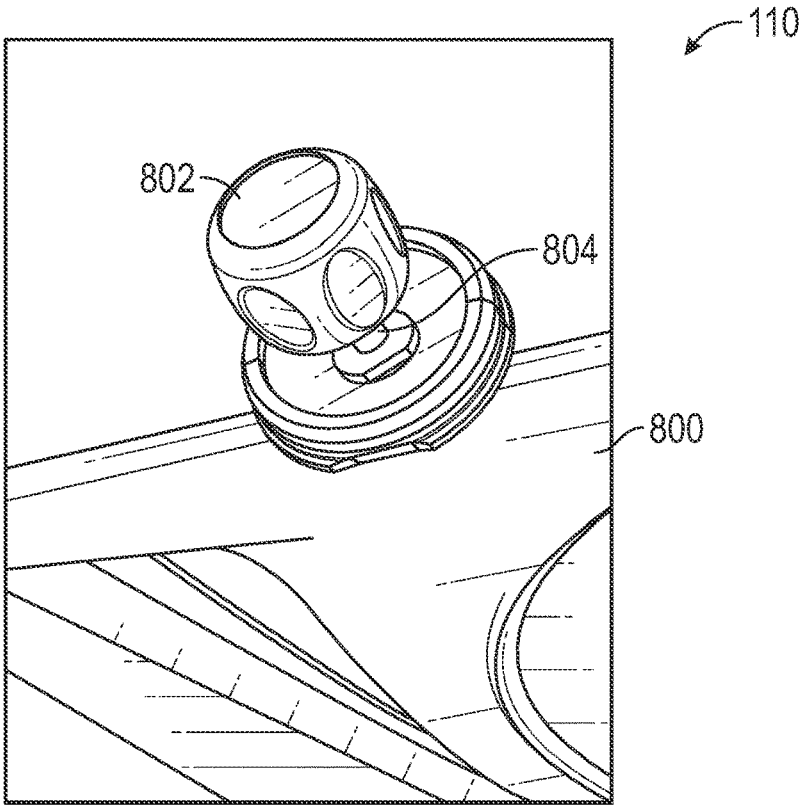
FIG. 11 is an illustration of a stationary bicycle showing an operational sequence that may be performed when engaging an emergency brake system of a stationary bicycle using a locking device, according to some embodiments of the present disclosure.
Figure 12:
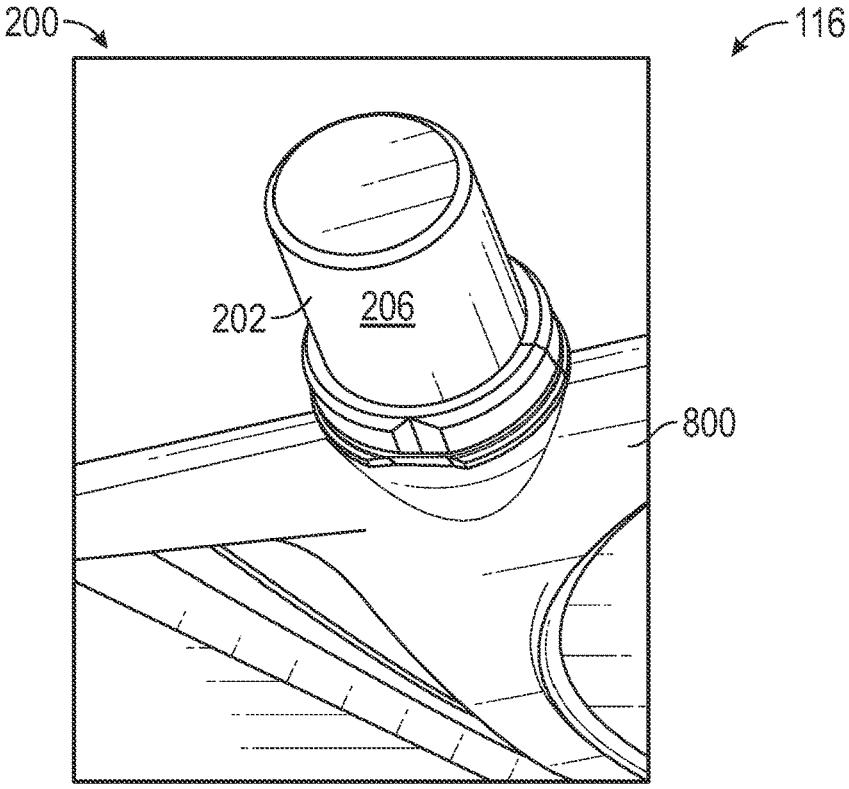
FIG. 12 is an illustration of a stationary bicycle showing an operational sequence that may be performed when engaging an emergency brake system of a stationary bicycle using a locking device, according to some embodiments of the present disclosure.

FIGS. 1A to 1B are flowcharts that describe a method of engaging an emergency brake of a stationary bicycle using a locking device, according to some embodiments of the present disclosure. In some embodiments, at 102, the method may include providing the stationary bicycle having an emergency brake (FIG. 8). At 104, the method may include loosening the fastener that stabilizes the rod to the stationary bicycle (FIG. 9). At 106, the method may include providing the locking device. At 108, the method may include positioning the base of the locking device between the stationary bicycle and the fastener (FIG. 10). At 110, the method may include positioning the aperture of the base of the locking device around at least a portion of the rod (FIG. 11).

Figure 2:
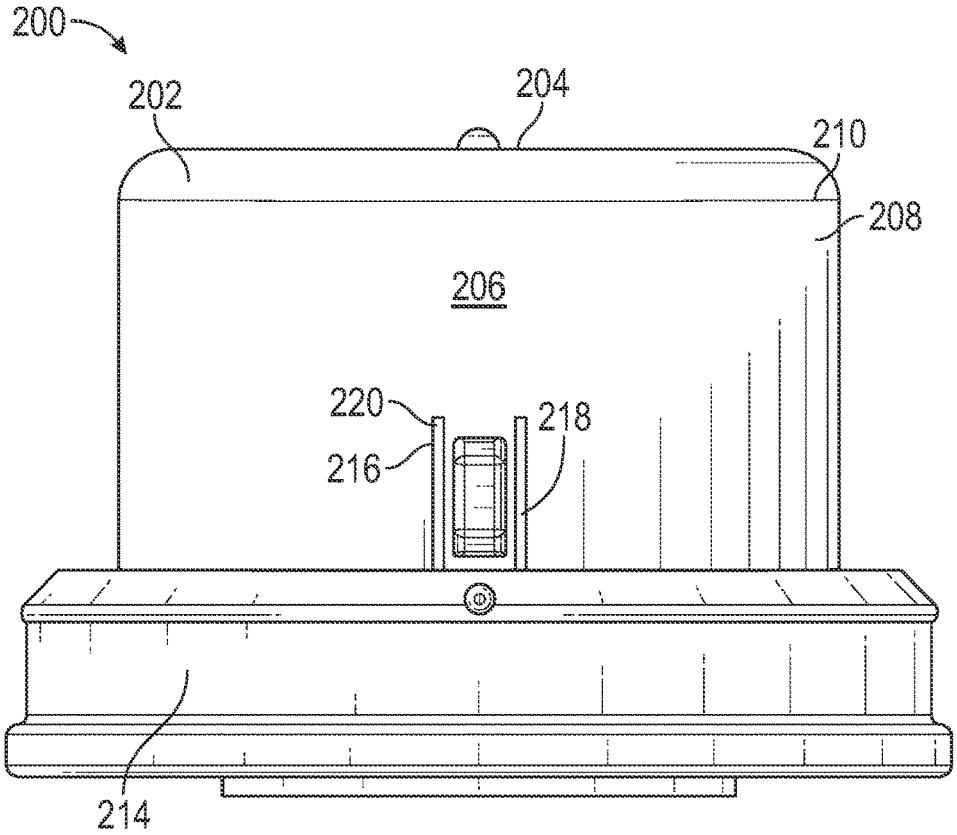
FIG. 2 is a side perspective view of the locking device having a housing connected to a capturing structure, according to some embodiments of the present disclosure.
Figure 3:
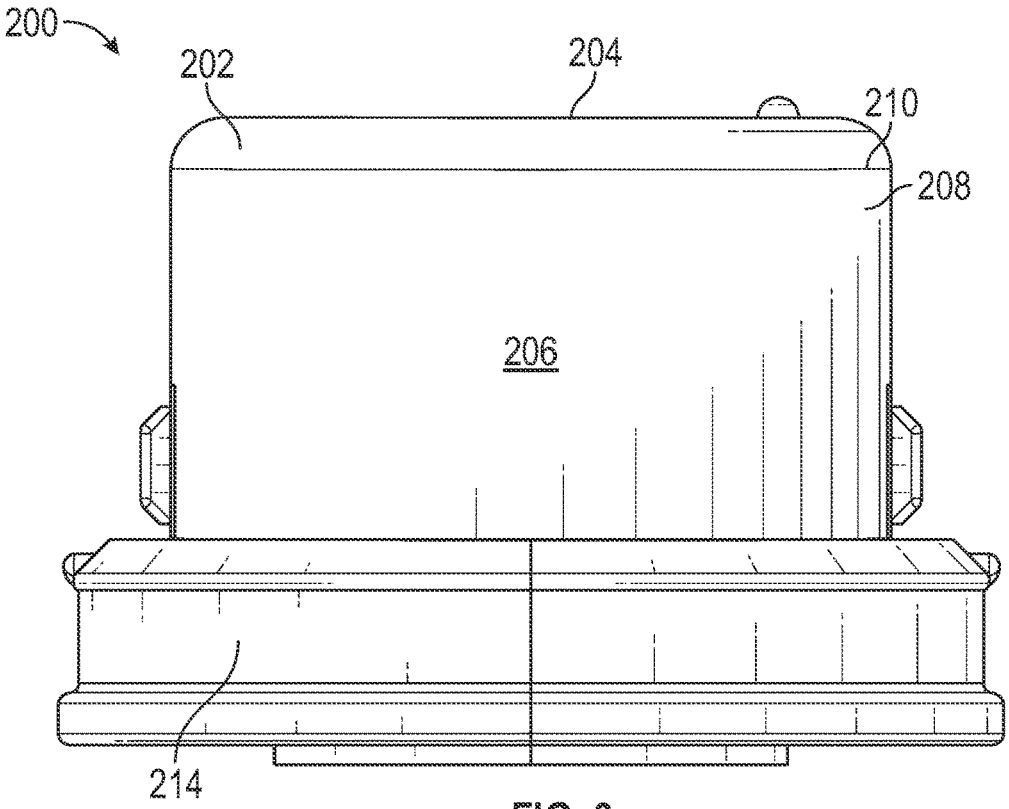
FIG. 3 is a front perspective view of the locking device having a housing connected to a capturing structure, according to some embodiments of the present disclosure.
Figure 4:
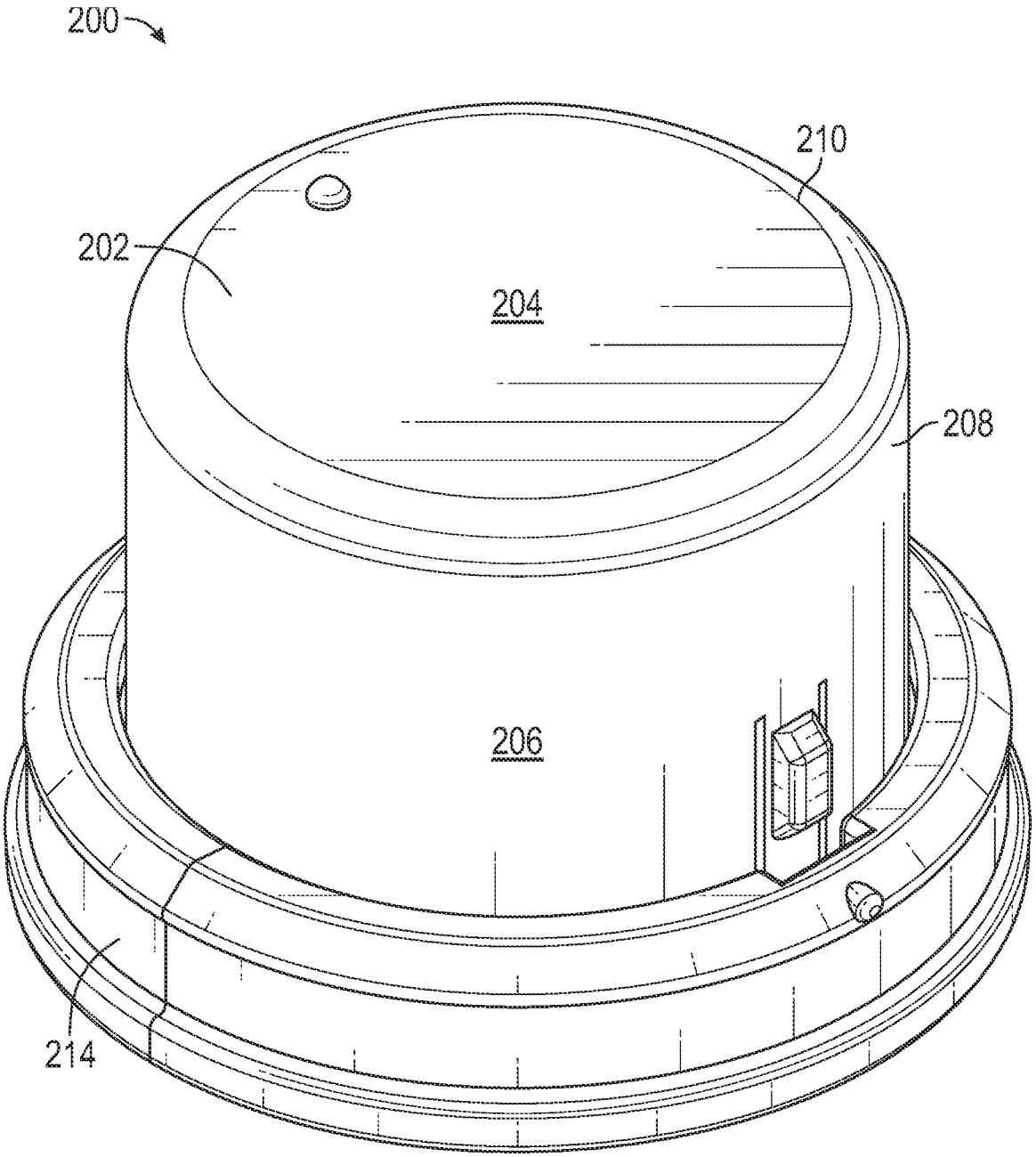
FIG. 4 is a top perspective view of the locking device having a housing connected to a capturing structure, according to some embodiments of the present disclosure.

In some embodiments, at 112, the method may include aligning the first latch of the housing with the capturing structure of the base. At 114, the method may include inserting the knob and at least a portion of the rod of the stationary bicycle into the chamber of the housing of the locking device. At 116, the method may include applying a force to the housing so that the knob receiving wall of the housing may depress the knob and rod to engage the emergency brake of the stationary bicycle when housing 202 is installed on capturing structure 214 (FIG. 2). In some embodiments, the steps of the method may include 102 to 116.

Figure 5:
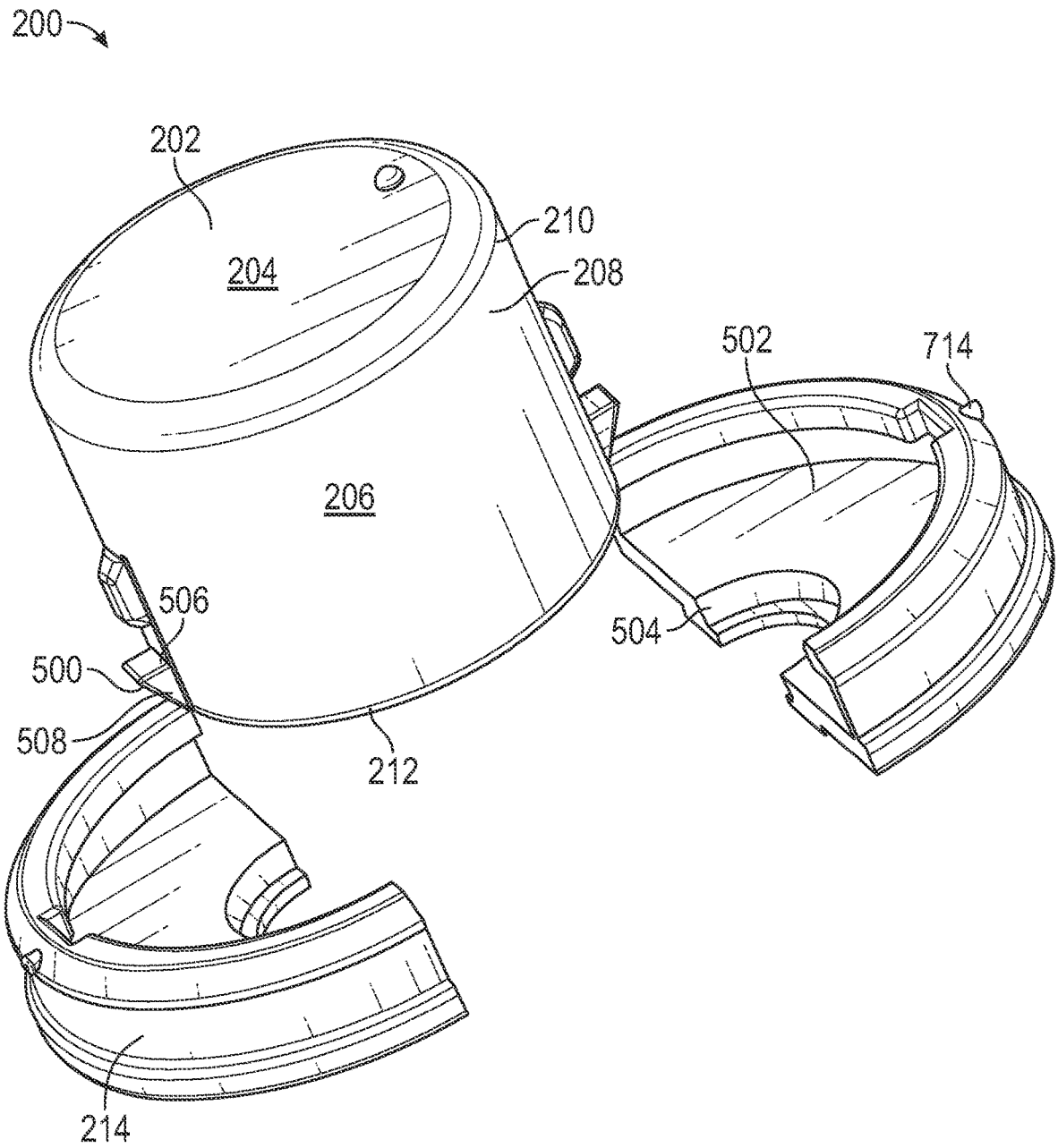
FIG. 5 is a top exploded view of the locking device having a housing configured to be connected to a capturing structure, according to some embodiments of the present disclosure.
Figure 6:
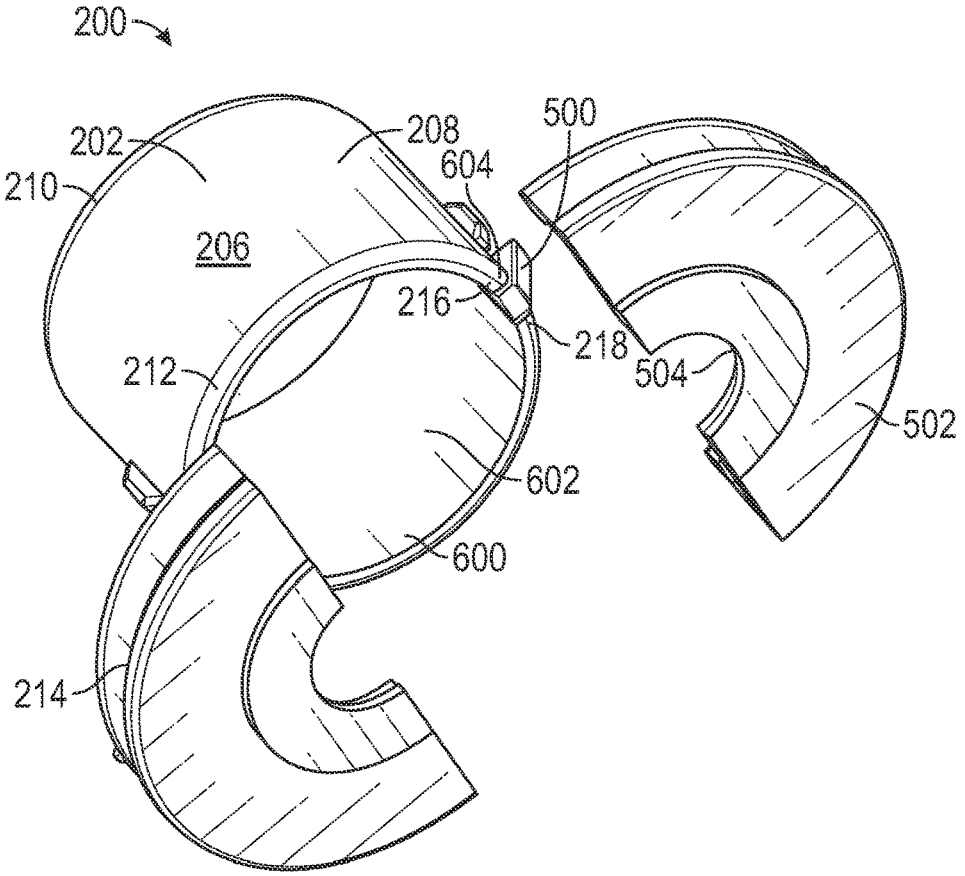
FIG. 6 is a rear exploded view of the locking device having a housing configured to be connected to a capturing structure, according to some embodiments of the present disclosure.
Figure 7:
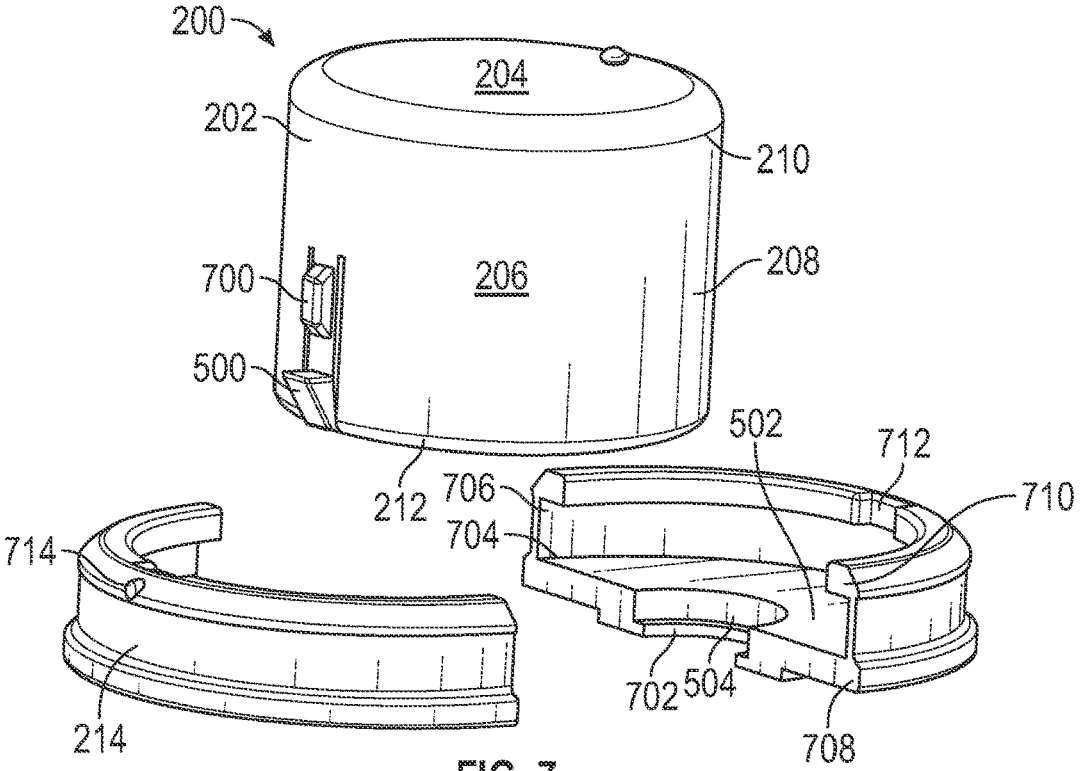
FIG. 7 is a side exploded view of the locking device having a housing configured to be connected to a capturing structure, according to some embodiments of the present disclosure.

FIGS. 2, 3, 4, 5, 6, and 7 show locking device 200 for a stationary bicycle 800 (FIGS. 8, 9, 10, 11, 12, 13, and 14). Locking device 200 has housing 202 including knob receiving wall 204. Sidewall 206 has outer wall surface 208. Sidewall 206 has first end 210 connected to knob receiving wall 204. FIGS. 5-7 best show sidewall 206 having second end 212 forming opening 600 (FIG. 6). Knob receiving wall 204 is located opposite opening 600 of housing 202. Chamber 602 (FIG. 6) is configured to receive knob 802 (FIGS. 8-14) connected to rod 804 (FIGS. 8-14). It is within the scope of this invention for knob 802 to include, but not be limited to, a resistance knob and/or an emergency brake knob for a stationary bicycle 800. Referring now to FIG. 6, opening 600 of sidewall 206 borders chamber 602.

FIG. 5 shows first latch 500 connected to outer wall surface 208 of sidewall 206 of housing 202. FIGS. 5-7 show base 502 having aperture 504. FIG. 10 best shows aperture 504 is configured to receive at least a portion of rod 804. First latch 500 of housing 202 is removably connected to capturing structure 214 of 502 base. Knob receiving wall 204 of housing 202 is configured to connect to the knob and depress the knob to engage an emergency brake when the housing is connected to the base.

FIG. 5 shows first latch 500 having first end 508 located opposite second end 506. First latch 500 is tapered. Second end 506 of first latch 500 having a greater thickness than first end 508 of first latch 500. First end 508 of first latch 500 abuts opening 600 of housing 202.

FIG. 2 shows housing 202 having first channel 216 and second channel 218. First channel 216 is parallel to second channel 218. The first channel 216 has first end 604 (FIG. 6) and second end 220 (FIG. 2). The first end of the first channel 216 and the first end of the second channel abut the opening of the housing. FIG. 6 best shows first latch 500 is located between first channel 216 and second channel 218.

FIG. 7 shows outer wall surface 208 of housing 202 having protrusion structure 700 in alignment with first latch 500. Protrusion structure 700 may be a ramp configured to be engaged by a user (not shown) to release first latch 500 of housing 202 from capturing structure 214 of base 502. Protrusion structure 700 is located between the first channel and the second channel to increase resilience and acts as a release mechanism. Aperture 504 of base 502 has flange 702 extending therefrom. Flange 702 is removably connected to second end 212 of sidewall 206 of housing 202. Capturing structure 214 has first end 704 and second end 706. First end 704 of capturing structure 214 is connected to outer perimeter edge 708 of base 502. Second end 706 of capturing structure 214 has protruded ridge 710 with at least one recess 712. Pin 714 (FIGS. 5 and 7) is configured to traverse through an opening (not shown) of protruded ridge 710 of second end 706 of capturing structure 214. Pin 714 is located within at least one recess 712. Pin 714 is configured to engage second end 506 of first latch 500 when housing 202 is connected to base 502.

Figure 13:
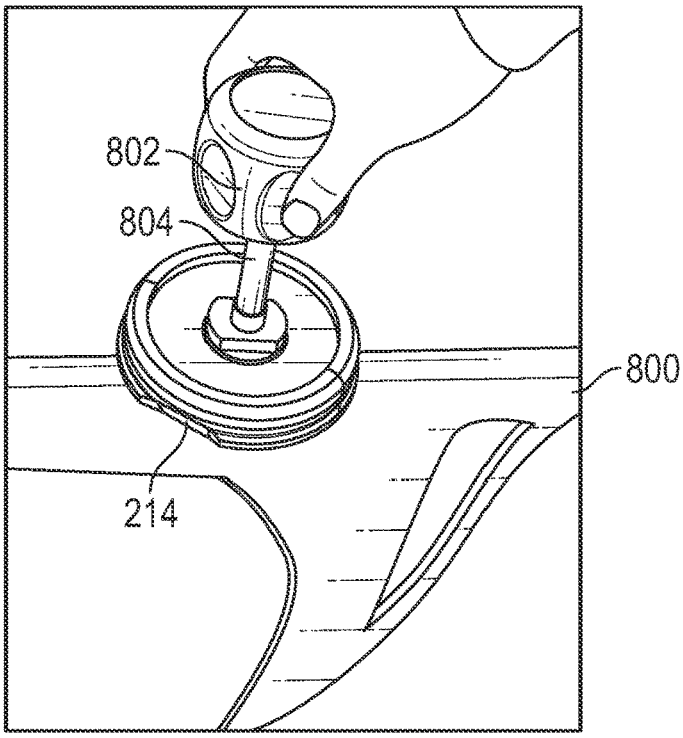
FIG. 13 is an illustration of a stationary bicycle showing an operational sequence that may be performed when engaging an emergency brake system of a stationary bicycle using a locking device, according to some embodiments of the present disclosure.
Figure 14:
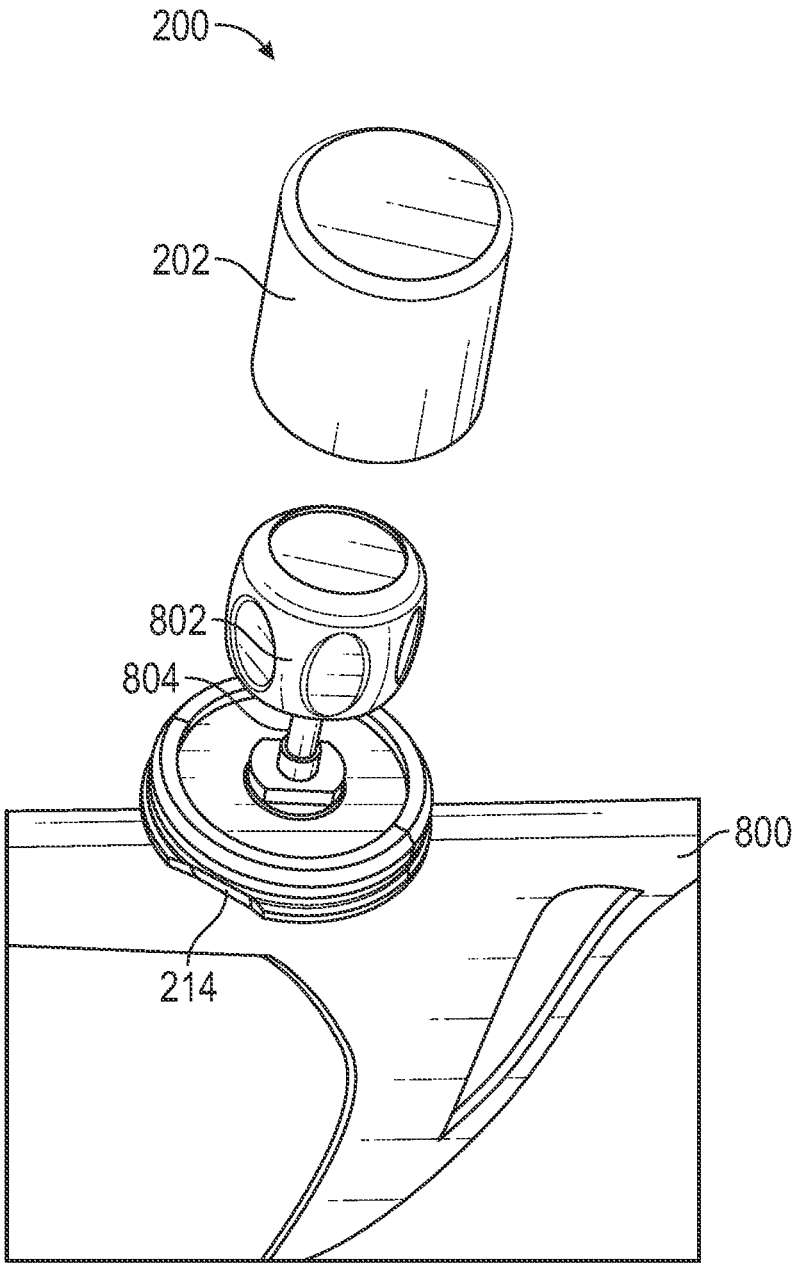
FIG. 14 is an illustration of a stationary bicycle showing an operational sequence that may be performed when engaging an emergency brake system of a stationary bicycle using a locking device, according to some embodiments of the present disclosure.

FIGS. 13-14 are an illustration of a stationary bicycle 800 showing an operational sequence that may be performed when engaging an emergency brake system of a stationary bicycle using a locking device. In particular, the capturing structure 214 is one piece rather than two halves as shown in FIGS. 2-8 and FIGS. 10-11.

Figure 15:
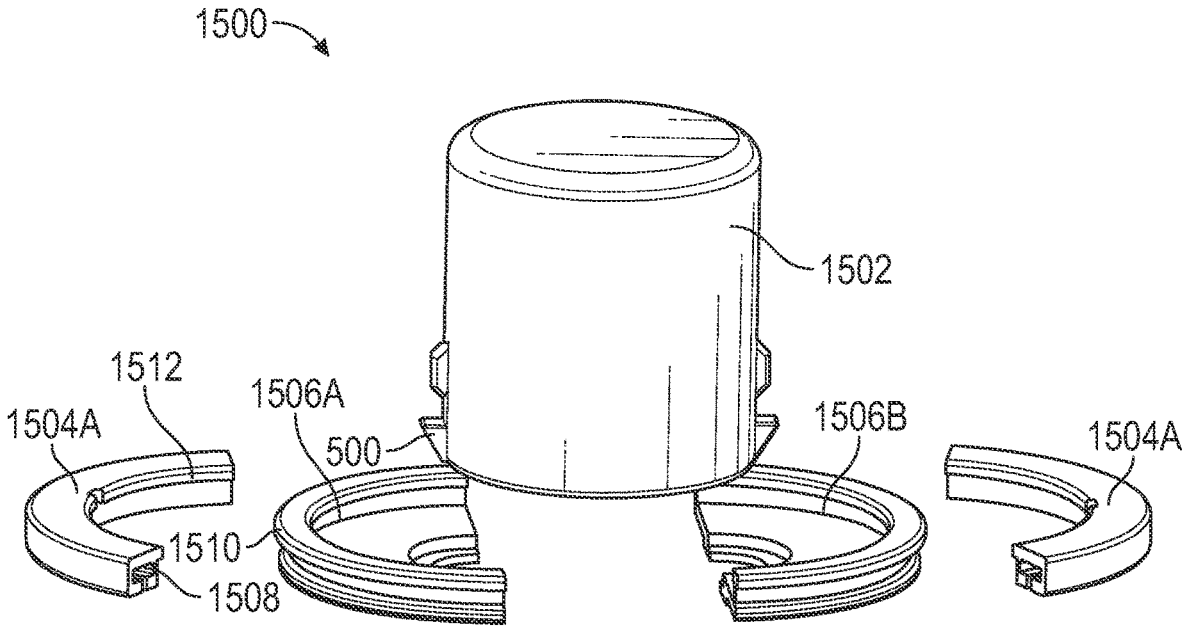
FIG. 15 is a side exploded view of an alternate embodiment of locking device having a housing connected to a capturing structure having detachable portions, according to some embodiments of the present disclosure.
Figure 16:
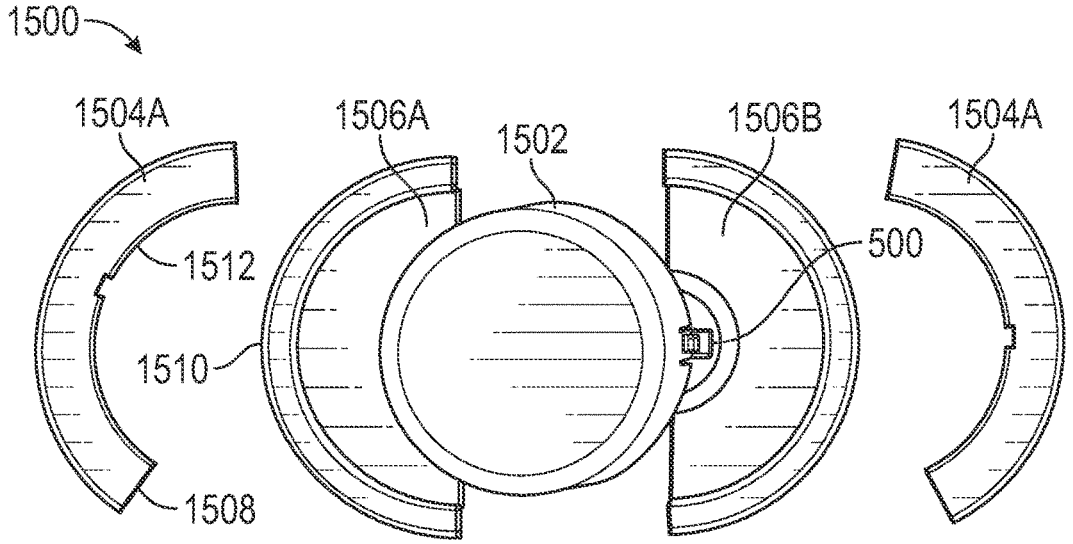
FIG. 16 is a top exploded view of an alternate embodiment of locking device having a housing connected to a capturing structure having detachable portions, according to some embodiments of the present disclosure.
Figure 17:
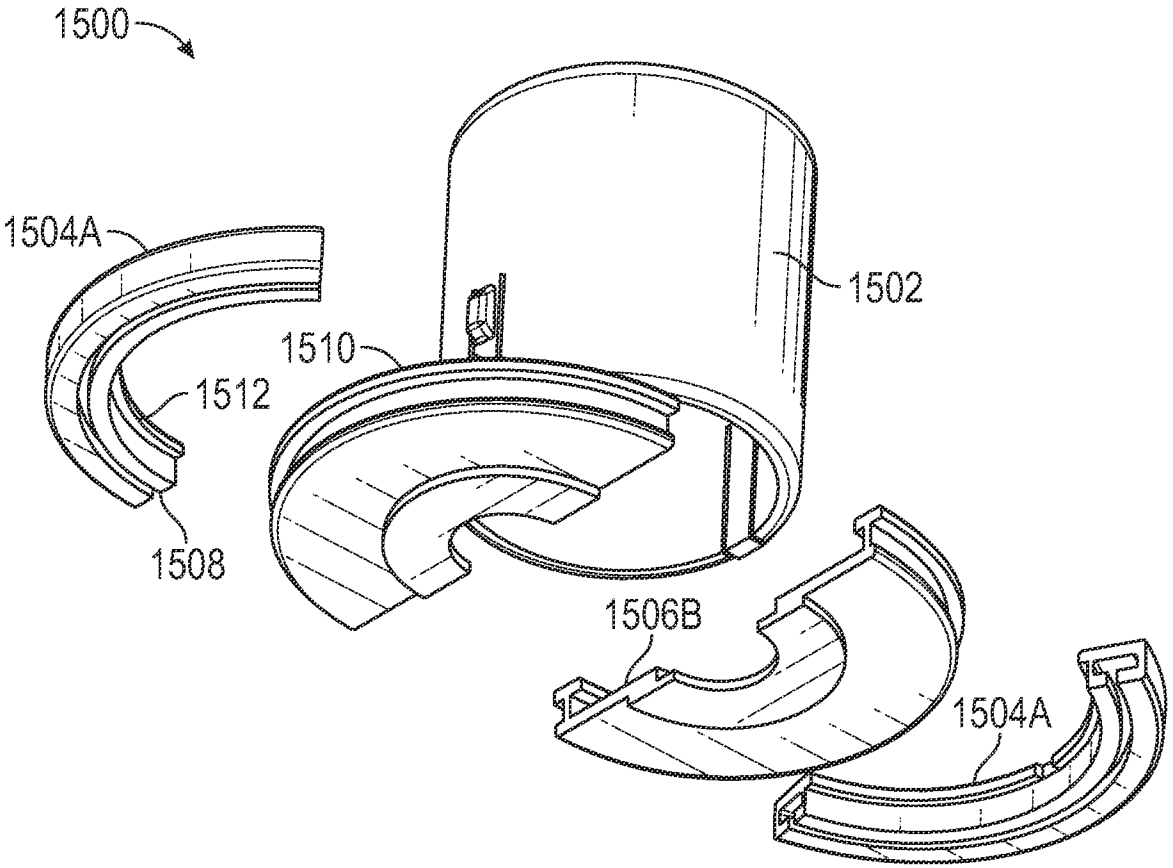
FIG. 17 is a rear exploded view of an embodiment FIG. 16 of locking device having a housing connected to a capturing structure having detachable portions, according to some embodiments of the present disclosure.
Figure 18:
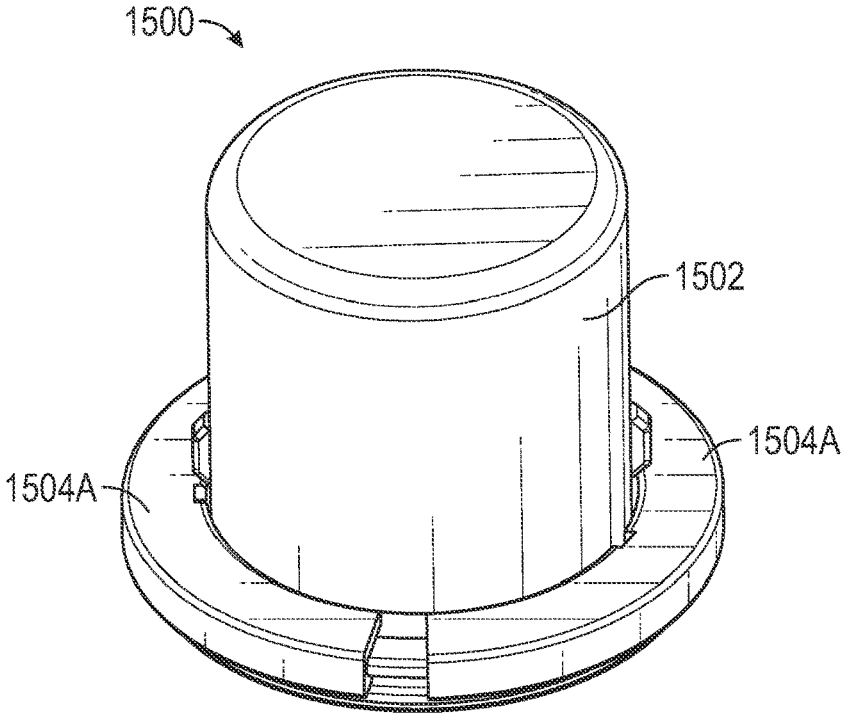
FIG. 18 is a perspective view of an embodiment FIG. 16 of locking device having a housing connected to a capturing structure having detachable portions, according to some embodiments of the present disclosure.
Figure 19:
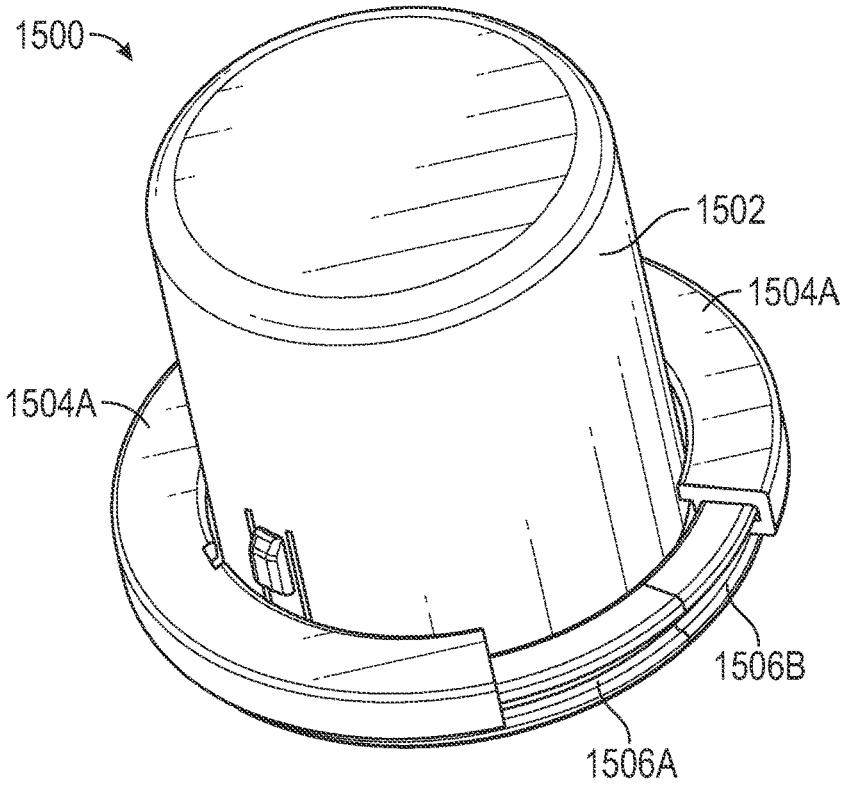
FIG. 19 is a perspective view of an embodiment FIG. 16 of locking device having a housing connected to a capturing structure having detachable portions, according to some embodiments of the present disclosure.
Figure 20:
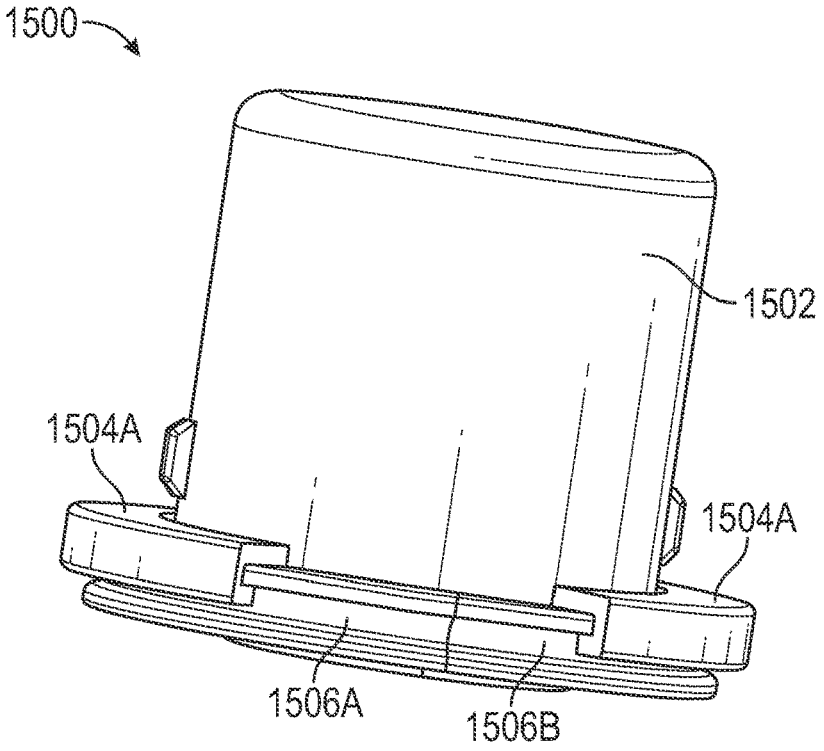
FIG. 20 is a side perspective view of an embodiment FIG. 16 of locking device having a housing connected to a capturing structure having detachable portions, according to some embodiments of the present disclosure.
Figure 21:
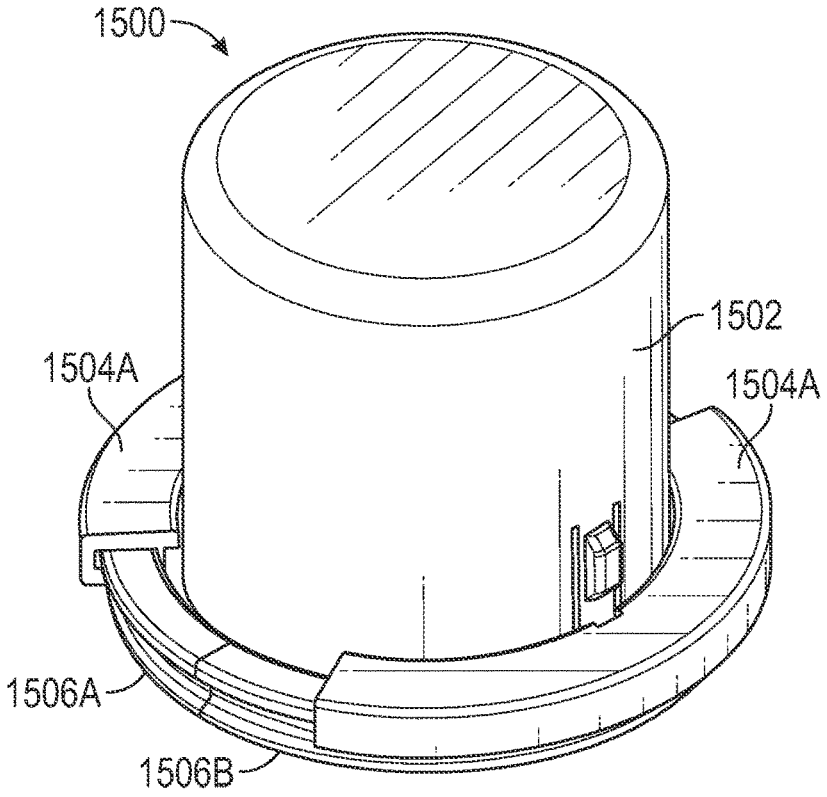
FIG. 21 is a perspective view of an embodiment FIG. 16 of locking device having a housing connected to a capturing structure having detachable portions, according to some embodiments of the present disclosure.

FIGS. 15-21 are an illustration of an alternate embodiment of locking device 1500. As best shown in FIG. 15, locking device 1500 has housing 1502 and capturing structure 1504A, 1504B removably connected to base 1506A, 1506B. The features of the base and capturing structure of at least FIGS. 2-7 may also be included in the embodiment of locking device 1500. The capturing structure 1504A, 1504B and base 1506A, 1506B may have one or more portions configured for easy installation and removal from a stationary bicycle (not shown). In an example, capturing structure 1504A has track 1508 configured to receive flange 1510 of base 1506A. Housing 1502 is removably connected to central opening of base 1506A, 1506B. FIG. 19 best shows a structural orientation of locking device 1500 configured to keep housing 1502 retained on and/or connected to base 1506A, 1506B. In particular, flange 1510 is configured to slidably traverse track 1508 so that a portion of protruding ridge 1512 of capturing structure 1504A overlays first latch 500. FIG. 21 best shows protruding ridge 1512 having one or more openings 1514 aligned with first latch 500 when capturing structures 1504A, 1504B are rotated so that flange 1510 traverses at least a portion of a length of track 1508 of capturing structures 1504A, 1504B.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated by some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the invention as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Additional Description

As described above, the present disclosure relates, in various aspects, to a lock device for a stationary bicycle. This invention is a device currently compatible with Peloton spin bikes, activates the emergency brake on the spin bike, immobilizes the function of the resistance knob and pedals and requires a specific sequence to unlock the mechanism and release the emergency brake. The issues this invention addresses is the potential risk of unattended toddlers or children sustaining injuries from fiddling with a functioning spin bike within the home.

A child proof/safety lock covering the spin knobs on an exercise bike/device. For this assessment, the search focused on finding the following elements: E1: A child safety lock comprises a top housing portion for covering a knob on a device. E2: A lower housing portion comprises i) first half and ii) second half for engaging with the device and latching the child safety lock onto the device when the two halves are coupled together. E3: A sequence (movements/rotations/activations etc.) resulting in unlocking the top housing portion from the lower housing portion.

In an embodiment, a lock mechanism for a stationary bicycle has a top housing, a bottom or base housing with two halves, and requires a user to perform the action of turning/actuating/pressing etc. to open the top housing. It is within the scope of this invention for the base bottom of the housing to be made of one solid piece or 2 portions. The benefit of the base bottom being made of two portions is that a user only is required to loosen the fastener connected to the bicycle and traverse the fastener along the rod during installation of the base bottom. With the use of a two-piece base bottom, the user is not required to completely remove the resistance/emergency brake knob from the rod, which requires an additional step of removing a cap and removing a fastener connecting the knob to the rod, during installation of the base bottom onto the rod.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entirety are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

What is claimed:

1. A locking device for a stationary bicycle, comprising:
a housing, comprising:
a knob receiving wall;
a sidewall having an outer wall surface, the sidewall having a first end connected to the knob receiving wall, the sidewall having a second end forming an opening, wherein
the knob receiving wall is located opposite the opening of the housing; and
a chamber, the chamber configured to receive a knob connected to a rod, wherein
the opening of the sidewall borders the chamber;
a first latch connected to the outer wall surface of the sidewall of the housing; and
a base, comprising:
an aperture, the aperture configured to receive at least a portion of the rod; and
a capturing structure, wherein
the first latch of the housing is removably connected to the capturing structure of the base, wherein
the knob receiving wall of the housing is configured to connect to the knob and depress the knob to engage an emergency brake when the housing is connected to the base.

2. The locking device of claim 1, wherein
the first latch has a first end located opposite a second end, and the first latch is tapered.

3. The locking device of claim 2, wherein
the second end of the first latch has a greater thickness than the first end of the first latch, and the first end of the first latch abuts the opening of the housing.

4. The locking device of claim 1, wherein the housing has a first channel and a second channel, the first channel is parallel to the second channel, the first channel has a first end and a second end, and the first end of the first channel and the second channel abut the opening of the housing.

5. The locking device of claim 4, wherein the first latch is located between the first channel and the second channel.

6. The locking device of claim 4, wherein the outer wall surface of the housing has a protrusion structure, and the protrusion structure is in alignment with the first latch.

7. The locking device of claim 6, wherein the protrusion structure is a ramp, the ramp is configured to be engaged by a user to release the first latch of the housing from the capturing structure of the base, and the protrusion structure is located between the first channel and the second channel.

8. The locking device of claim 1, wherein the aperture of the base has a flange extending therefrom, and the flange is removably connected to the second end of the sidewall of the housing.

9. The locking device of claim 1, wherein the capturing structure further comprises:

a first end and a second end, the first end of the capturing structure connected to an outer perimeter edge of the base, the second end of the capturing structure having a protruded ridge;

at least one recess; and a pin, the pin configured to traverse through an opening of the protruded ridge of the second end of the capturing structure, the pin located within the at least one recess, and the pin configured to engage the second end of the first latch when the housing is connected to the base.

10. The locking device of claim 1, wherein a second latch is connected to the outer wall surface of the sidewall of the housing, and the second latch of the housing is removably connected to the capturing structure of the base.

11. A method of engaging an emergency brake of a stationary bicycle using a locking device, comprising the steps of:

providing the stationary bicycle, the stationary bicycle having the emergency brake, the stationary bicycle comprising:

a brake system;

a knob;

a rod, the rod having one end connected to the knob located opposite another end coupled to the brake system; and a fastener, the fastener connecting the rod to the stationary bicycle;

loosening the fastener;

providing the locking device, comprising:

a housing, comprising:

a knob receiving wall;

a sidewall having an outer wall surface, the sidewall having a first end connected to the knob receiving wall, the sidewall having a second end forming an opening, wherein the knob receiving wall is located opposite the opening of the housing; and a chamber, the chamber configured to receive the knob connected to the rod of the stationary bicycle, wherein the opening of the sidewall borders the chamber;

a first latch connected to the outer wall surface of the sidewall of the housing; and a base, comprising:

an aperture, the aperture configured to receive at least a portion of the rod; and a capturing structure, wherein the first latch of the housing is removably connected to the capturing structure of the base, wherein the knob receiving wall of the housing is configured to connect to the knob and depress the knob to engage the emergency brake when the housing is connected to the base;

positioning the base of the locking device between the stationary bicycle and the fastener;

positioning the aperture of the base of the locking device around at least a portion of the rod;

aligning the first latch of the housing with the capturing structure of the base;

inserting the knob and at least a portion of the rod into the chamber of the housing of the locking device; and applying a force to the housing so that the knob receiving wall of the housing is depressing the knob and rod to engage the emergency brake of the stationary bicycle, wherein a length of the knob and the rod retained within the chamber of the housing is greater in size than a length of the chamber of the housing.

* * * * *